US008393360B2

(12) United States Patent
Brakefield et al.

(10) Patent No.: US 8,393,360 B2
(45) **Date of Patent: *Mar. 12, 2013**

(54) FUEL TRANSFERRING SYSTEM AND METHOD OF USE

(75) Inventors: Michael C. Brakefield, Yukon, OK (US); Joshua Edge, League City, TX (US); Steven C. Strobel, Marquette, NE (US); Leroy Zaruba, Clarks, NE (US)

(73) Assignee: Musket Corporation, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/351,888

(22) Filed: Jan. 17, 2012

(65) Prior Publication Data

US 2012/0111448 A1 May 10, 2012

Related U.S. Application Data

(63) Continuation of application No. 12/214,886, filed on Jun. 23, 2008, now Pat. No. 8,109,300.

(51) Int. Cl.
*B65B 1/08* (2006.01)

(52) U.S. Cl. ..... 141/67; 141/231

(58) Field of Classification Search ..... 141/67, 141/231, 95, 115, 116, 198, 83; 222/208, 222/626, 627, 680

See application file for complete search history.

(56) References Cited

U.S. PATENT DOCUMENTS

| | | | | |
|---|---|---|---|---|
| 3,672,180 | A | 6/1972 | Davis | |
| 3,677,284 | A | 7/1972 | Mendez | |
| 4,009,985 | A | 3/1977 | Hirt | |
| 5,609,191 | A | 3/1997 | Topping et al. | |
| 6,176,279 | B1 | 1/2001 | Dahlin et al. | |
| 6,213,515 | B1 | 4/2001 | La Terra | |
| 6,538,261 | B1 | 3/2003 | McConnel et al. | |
| 6,689,196 | B2 | 2/2004 | Amano et al. | |
| 6,766,837 | B1 | 7/2004 | Ruffa | |
| 6,945,288 | B1 | 9/2005 | Brakefield et al. | |
| 7,156,134 | B1 | 1/2007 | Brakefield et al. | |
| 7,308,918 | B1 | 12/2007 | Brakefield | |
| 8,109,300 | B2 * | 2/2012 | Brakefield et al. | 141/67 |

* cited by examiner

*Primary Examiner* — Davis Hwu
(74) *Attorney, Agent, or Firm* — McAfee & Taft

(57) ABSTRACT

A portable system for transferring liquids such as fuels from a first tank to a second tank. The first tank may be, for example, a railcar and the second tank a transport trailer. The portable system is separated into multiple compartments with an engine compartment and a pump compartment. A wall separates the engine and pump compartments and may be sealed to prevent the passage of air or vapor therethrough. The pump is utilized to transfer liquid from the first tank to the second tank.

18 Claims, 5 Drawing Sheets

FUEL TRANSFERRING SYSTEM AND METHOD OF USE

CROSS REFERENCE TO RELATED APPLICATIONS

This application is a continuation of U.S. application Ser. No. 12/214,886 filed Jun. 23, 2008, now U.S. Pat. No. 8,109,300.

BACKGROUND

This disclosure relates to equipment for unloading liquid bulk products such as diesel or other fuel from one storage or transport tank to another, such as from a railcar to a transport trailer, and more particularly, to a portable system for unloading a railcar into a transport trailer, or for unloading a transport trailer into a railcar, without the necessity of any permanently installed equipment and which can be used at virtually any site at which access to the railcar is available.

The use of railroad tank cars for bulk transportation of petroleum and other bulk liquid products is well known. It is also known to transport such fluids over the highways by truck using specially designed transport trailers, often called tanker trailers.

The railcars have top and bottom openings therein through which the railcars can be loaded and unloaded. Valves are used to open and close the openings. Normally, loading the railcar is done at a refinery site. When the railcars travel to an unloading terminal, permanent equipment is used to unload the railcar and transfer the product therein to another vessel of some sort. This might be a stationary storage tank, but often is a transport trailer. Both the stationary tanks and the tanks on the transport trailers also have openings therein with valves controlling them through which these vessels can be loaded and subsequently unloaded. It is not uncommon for these tanks to have separate compartments for different products, for example, diesel fuel and gasoline. Separate openings and valves are used for the different compartments.

When transferring a fuel, the previously mentioned permanent system is used. Such a permanent system includes a pump, usually driven by an explosion-proof electric motor and a meter downstream of the pump to measure and frequently record the amount of fuel transferred. An inlet hose is connected between inlet piping to the pump and the valve on the railcar, and an outlet hose is connected between outlet piping from the meter and the desired valve on the transport trailer. These hoses may have grounding wires woven therein so that when they are connected to metal piping, valves, etc., the chance of static electricity is minimized. This is necessary because a small spark could ignite the products being transferred or at least vapors therefrom.

In these prior art permanent installations, obviously it is necessary to take the transport trailer to the terminal to which the railcars have been brought. The unloading of the product from the railcar cannot take place anywhere else. Therefore, if it is desired to unload the railcar at any other site, the permanent system is unusable. Thus, there is a need for a system which can be used to transfer product from a railcar when it is parked at a site which does not have an unloading terminal located there.

In permanent installations, although some lengths of hoses are used, most of the piping is fixed, and it does not matter if fluids remain therein after a transferring or pumping cycle. Any spillage is caught in permanent areas around the system. In the portable system disclosed herein, there is a relatively small amount of fixed piping in the trailer, and most of the connections between the railcar and the transport trailer are with flexible hoses. When the pumping is done, the outlet hose will still be full of fluid. After disconnecting such a hose, the hose would be extremely heavy and difficult to handle and there would be spillage of some, if not most, of the liquid in the hose. This not only would waste valuable product, such as fuel, but such spills would be detrimental to the environment and most likely would violate environmental laws or regulations.

In today's petroleum market, fuel prices can fluctuate significantly depending on economic and world conditions and events. Marketers of petroleum products, such as fuel, want to find the fuel at the least possible price in order to have a competitive advantage, or at least to be competitive with other marketers. Often, a lower price might be found at some distance away from the marketer's normal supply point. In such cases, marketers may take their transport trucks to those more remote locations to load with petroleum products if the cost of transportation is not prohibitive. This still requires the transport truck to be taken to a terminal where railcars are being unloaded, and this may add more cost than can be absorbed by the marketer. Also, even once at the terminal, it may take some time for a particular transport truck to be filled if a number are waiting. If unloading could be speeded up, this would be an advantage for everyone. Further, sometimes the railcars are still at a siding somewhere and not yet located at a terminal, and currently, this means they cannot be unloaded until they are moved to a terminal. This may result in a time delay which increases the cost of transportation for the suppliers who move the products by rail. If railcars could be unloaded earlier, the supplier would get paid sooner, and the railcar could be turned around more quickly to be reloaded. Also, if unloading could be accomplished more quickly, marketers might be able to buy it at a lower price and get the petroleum into the marketing stream earlier. All of this would improve cash flow at all levels of the petroleum market, from the supplier to retail consumers.

Apparatus and methods for addressing some of the concerns are disclosed in U.S. Pat. Nos. 6,945,288, 7,156,132 and 6,945,288. There is, however, a continuing need for methods and apparatus that provide for the quick, safe and efficient transfer of all types of bulk liquids.

SUMMARY

A portable system for transferring a liquid from a first tank to a second tank comprises a trailer connected to and towable by a vehicle. A pump mounted on the trailer has a pump inlet and a pump outlet. The system includes an inlet hose connectable to the first tank and to the pump inlet and an outlet hose connectable to the second tank and the pump outlet. A vapor conduit is connectable to the first tank and has a second end connectable to the second tank. The pump may be driven, for example, by an electric motor. Power may be supplied to the electric motor from a generator mounted to the trailer. An engine which may use, for example, diesel fuel or other type of fuel drives the generator which then supplies power to the pump motor and other components of the system which require electric power. The engine is positioned in an engine compartment on the trailer while the pump and pump motor are positioned in a pump compartment. The engine and pump compartments are separated by a wall which is sealed to prevent air or vapor from passing between the two compartments. A computer is mounted in the trailer and will receive signals from a flow meter and temperature sensor and will utilize those variables to convert the gross amount of liquid transferred to a net amount so that transactions may be completed immediately following completion of the transfer of the liquid. When the pump is used to transfer liquid from the first tank to the second tank, vapor from the second tank is communicated into the first tank through the vapor conduit, so there is little, or no escape of vapor into the air while the system is operating.

DETAILED DESCRIPTION OF A PREFERRED EMBODIMENT

Figure 1:
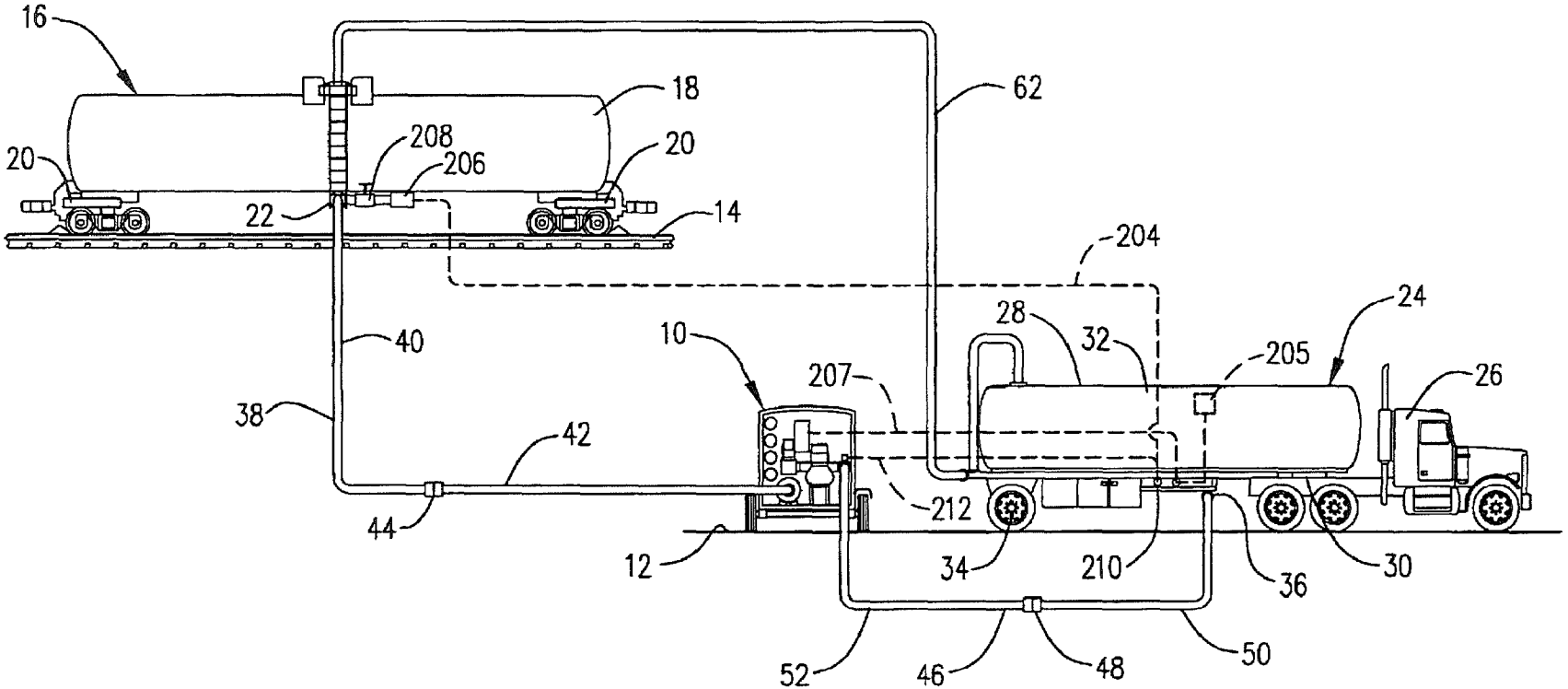
FIG. 1 is a top view of a liquid transfer system connected between a railcar and a transport trailer.

Referring now to the drawings, and more particularly to FIG. 1, the bulk liquid transferring system of the present invention is shown and generally designated by the numeral 10. Bulk liquid transferring system 10 may also be referred to as fuel transferring system 10. System 10 is shown positioned on a ground surface 12 adjacent to railroad tracks 14. FIG. 1 is for illustration purposes only, and it is not intended to convey the impression that tracks 14 are at a higher elevation than ground surface 12. No specific relative height is necessary for system 10 to be used. Liquid transferring system 10 may be used to transfer different types of liquids and is suitable for the safe and efficient transfer of both high flash and low flash liquids, such as fuels.

A railroad tank car 16, also referred to simply as railcar 16, is positioned on tracks 14. Of course, more than one railcar 16 may be present at any time. Railcar 16 is of a kind known in the art and has a railcar tank 18 mounted on rail trucks 20. At the bottom of tank 18 is a railcar valve 22 through which the liquid in the tank may be emptied or unloaded.

Positioned adjacent to system 10 on ground surface 12 is a transport truck 24 of a kind known in the art. Transport truck 24 has a tractor 26 connected to a transport trailer 28 by a fifth wheel 30. Transport trailer 28 includes a truck tank 32 mounted on rear wheels 34. Tank 32 has a transport valve 36 on the bottom thereof through which the tank may be filled or loaded with liquid or through which the tank may be emptied or unloaded. Although tank 32 is illustrated for simplicity as having a single transport valve 36 thereon, transport trailer tanks typically have multiple liquid compartments therein with a separate transport valve for each.

An inlet hose 38 is connected to railcar valve 22 and to the system 10 in a manner detailed herein. Inlet hose 38 may comprise a plurality of lengths of inlet hoses such as length 40 and length 42 connected by coupling 44. An outlet hose 46 is connected to an outlet of system 10 and to transport valve 36. Outlet hose 46 may comprise a plurality of lengths of outlet hose such as length 52 and length 50 connected by coupling 48.

Railroad tank car 16 has a valved railcar vent 54. Transport truck 24 has a transport truck vent 56 and a vent valve 58. Vapors in truck tank 32 can be communicated through vent 56 when valve 58 is in an open position to a vent exhaust 60. Vent 56, valve 58 and exhaust 60 are generally typical features found on transport trailers. A vapor hose or vapor conduit 62 may be connected by fittings and couplings of a type known in the art to transport trailer 28 at vent exhaust 60 and to valved railcar vent 54. Thus, when system 10 is connected to railroad tank car 16 and transport trailer 28 by inlet hose 38, outlet hose 46 and vapor conduit 62 is connected to railcar vent 54 and vent exhaust 60, a closed liquid transfer system is created. System 10 will pump liquid, for example fuel from railroad tank car 16, through inlet hose 38. System 10 will pump fuel through outlet hose 46 into transport trailer 28. As liquid enters transport trailer 28, vapors therein will be communicated through vapor conduit 62 into railroad car 16 as liquid is emptying therefrom. Thus, there is little or no escape of vapors into the atmosphere and use of such a closed system renders system 10 usable with low flash fuels. Once liquid has been transferred using system 10, and transport truck 24 is moved, valves on railroad tank car 16 can be opened to vent the railroad tank car to the atmosphere.

Figure 2:
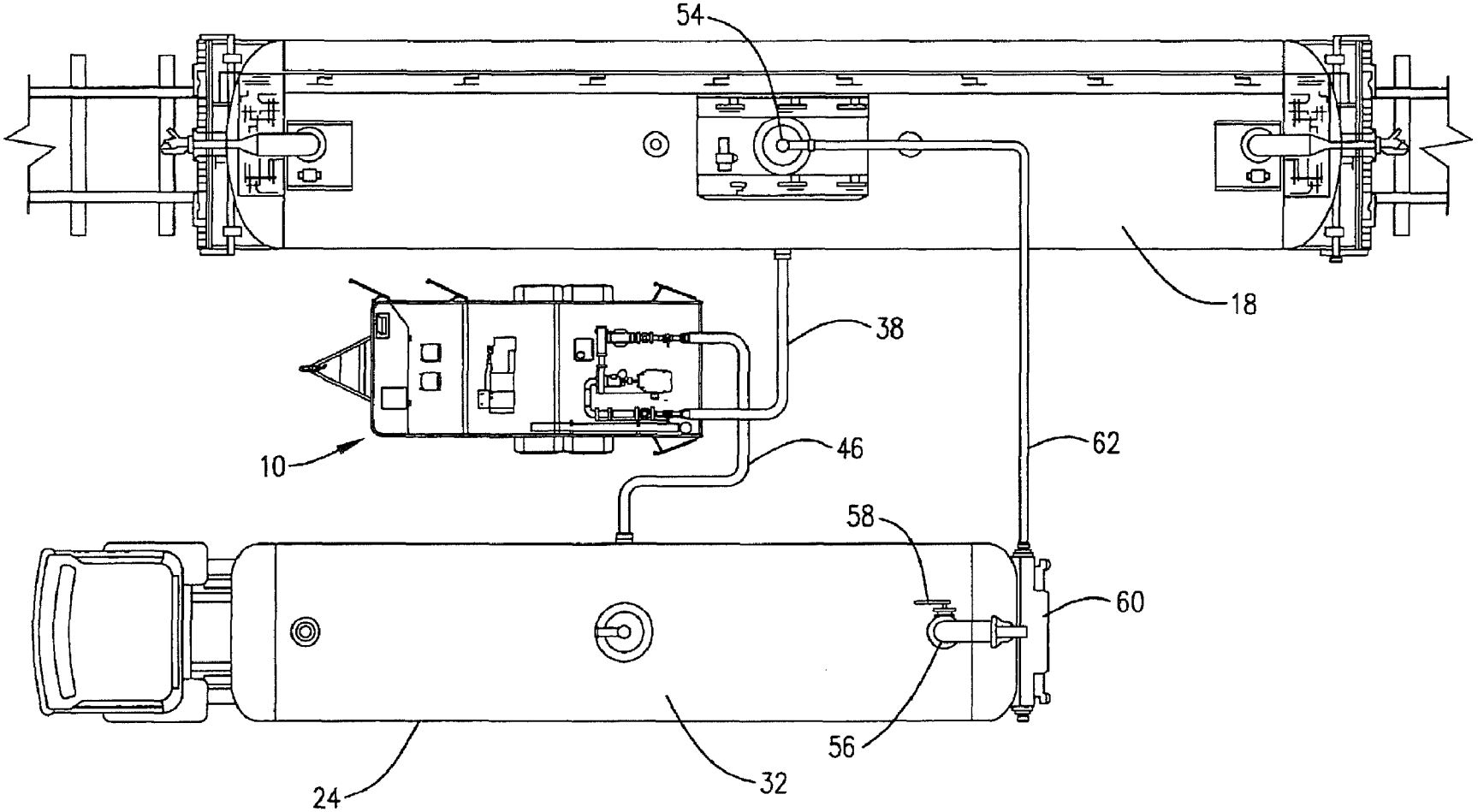
FIG. 2 is another view of the liquid transfer system connected between a railcar and transport trailer.

FIG. 2 is a view of the system 10 positioned differently than in FIG. 1, and illustrates that system 10 can be positioned and located as necessary to accommodate the position of railroad tank car 16 and transport truck 24.

Figure 3:
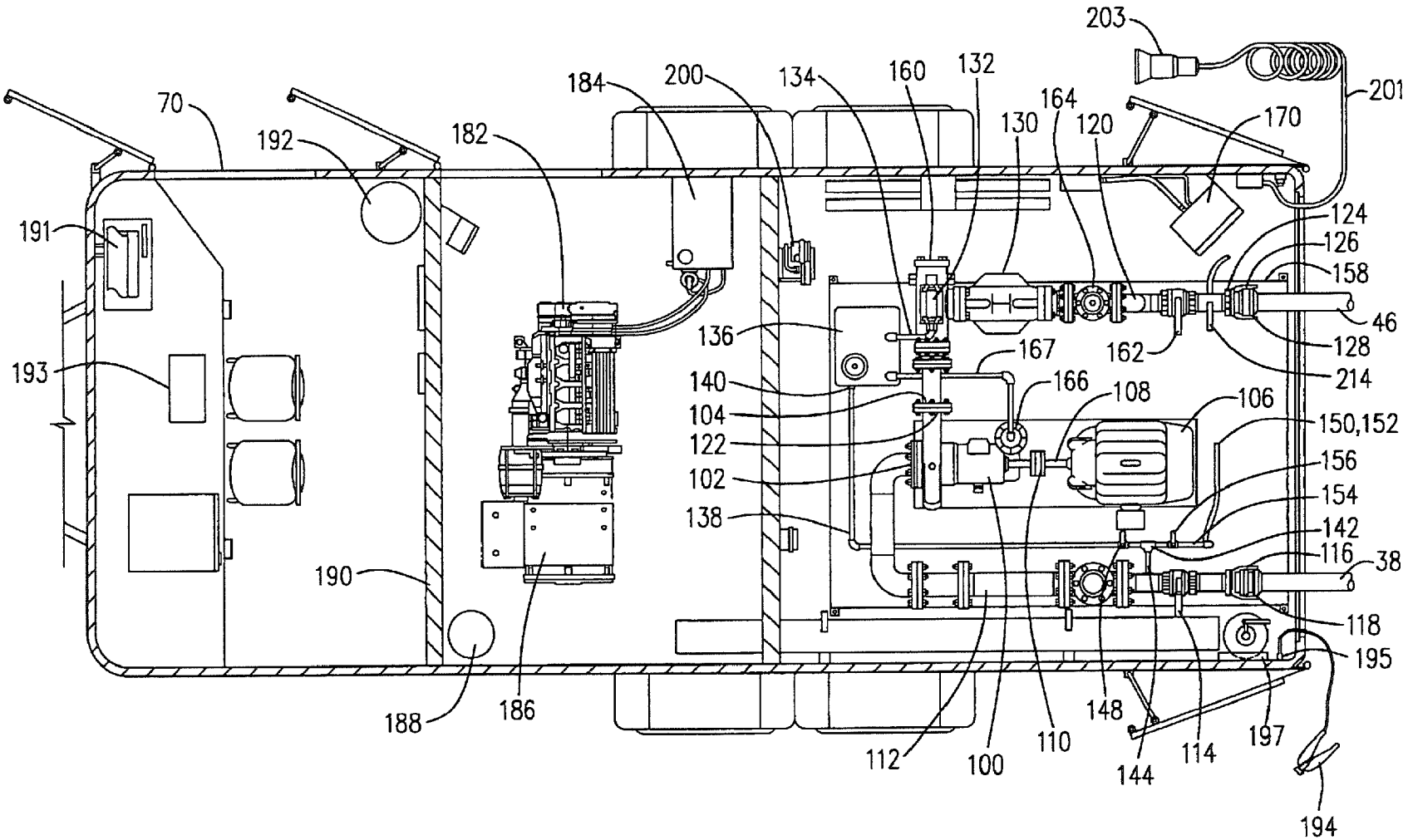
FIG. 3 is a view looking down into the towable trailer of the transfer system with the top trailer panel not shown.
Figure 4:
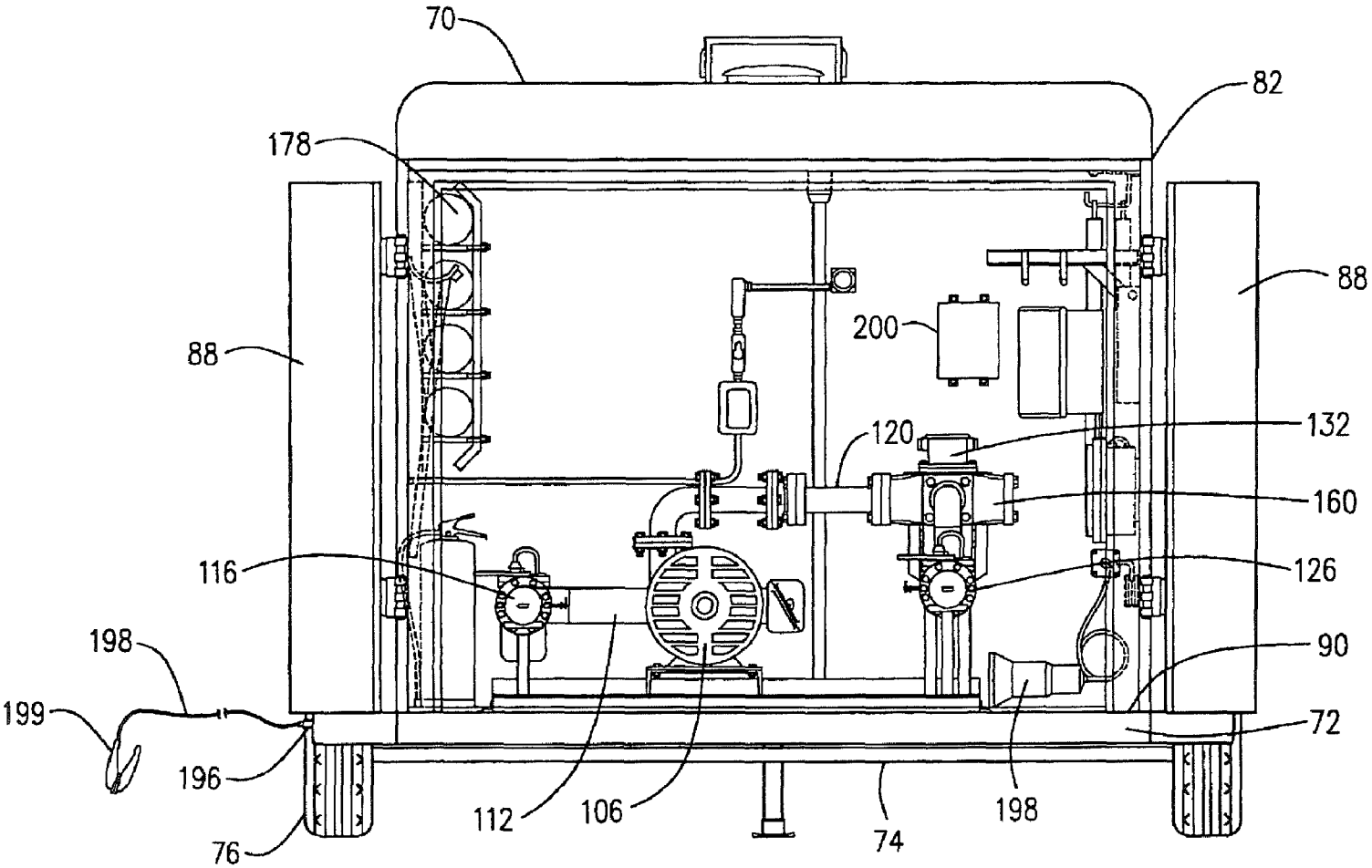
FIG. 4 is a view looking from the rear of the towable trailer.
Figure 5:
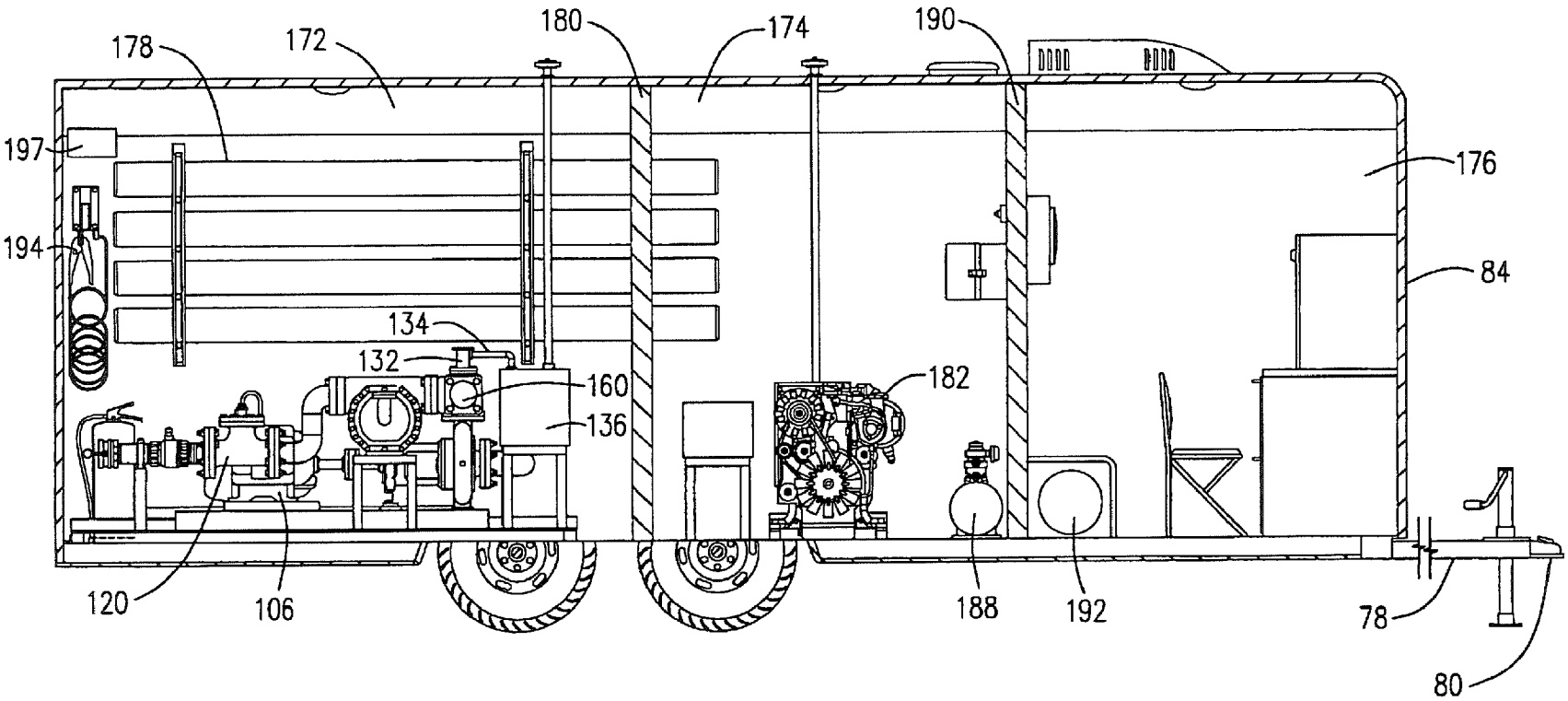
FIG. 5 is a view from the side of the towable trailer, with trailer side panels not shown.

Referring now to FIGS. 3-5, more details of system 10 will be described. System 10 comprises a trailer 70 that is connectable to and towable by a vehicle (not shown). Trailer 70 is of generally conventional construction and includes a frame 72 mounted on an axle 74 and supported on wheels 76. A tongue 78 extends from frame 72 and has a hitch 80 thereon for attachment to a vehicle adapted to tow trailer 70. Trailer 70 also has side walls 82 and a front wall 84. Trailer 70 may likewise include a top 86 and may have hinged rear doors 88. Trailer 70 may likewise have side doors that are hinged and/or slidable in tracks to provide access to the inside of trailer 70 from both the rear and the side. A floor 90 extends across frame 72.

Referring now to FIG. 3, a pump 100 which may be, for example, centrifugal pump 100, is mounted in trailer 70 and has a pump inlet 102 and pump outlet 104. A pump motor 106 which is preferably an explosion-proof, or intrinsically safe electric motor 106, is mounted in trailer 70 and has a shaft 108 extending therefrom which is coupled with a coupling 110 to a shaft extending from pump 100, so that pump 100 is driven by motor 106 through coupling 110. Pump 100 and pump motor 106 may, if desired, be mounted on a base mounted to floor 90. Shock absorbers and stabilizers may be utilized as well in connecting pump 100, motor 106 and other components of system 10 to the floor in trailer 70.

An inlet line 112 is connected at one end to pump inlet 102 and has an inlet valve 114 connected therein. Inlet valve 114 is movable between open and closed positions and may be, for example, a ball valve so that there is minimal pressure drop therethrough. On an end of the inlet line 112 is an inlet connector 116 which may be, for example, a cam lock or other threaded connector. A screen filter may be positioned in inlet line 112 as well. Hose coupling 118 adapted to connect to inlet connector 116 will connect inlet hose 38 to inlet line 112. An outlet line 120 is connected at one end 122 to pump outlet 104 and at a second end 124 has a cam lock or other connector 126 for connection to outlet hose 46 which will have a hose connector 128 of a type adapted to connect to connector 126. Inlet hose 38 is therefore connectable to pump inlet 102, in this case via pump inlet line 112. Likewise, outlet hose 46 is connectable to pump outlet 104, in this case via outlet line 120. The inlet hose 38 and inlet line 112 may be referred to collectively as an inlet conduit. The outlet hose 46 and outlet line 120 may be referred to as an outlet conduit.

System 10 comprises a flow meter 130 which will have an inlet that connects to pump outlet 104 so that liquid pumped by pump 100 will flow through flow meter 130. Flow meter 130 is of a type that measures the rate of flow therethrough, so that a total amount of flow and the total volume pumped can be determined. Flow meter 130 may be, for example, a Liquid Controls Model M40 flow meter. A pressure valve 132 forms a part of the inlet of meter 130. A pressure valve line 134 connects pressure valve 132 to a sealed vapor tank 136. Pressure valve 132 may be also referred to as an air eliminator. Pressure valve 132 is of a kind known in the art designed so that only liquid passes into meter 130. Thus, pressure valve 132 will remove air or liquid vapor which may comprise an air dispersion of particles of the liquid being pumped prior to the time the liquid reaches meter 130. The vapor will pass through the pressure valve line or vapor line 134 into sealed vapor tank 136. A recirculation conduit 138 is connected to sealed vapor tank 136 at a first end 140 and is connected at a second end 142 thereof to a connecting conduit 144. Connecting conduit 144 is connected at an end 146 thereof to inlet line 112. A valve 148 which may be a ball valve 148 is connected in recirculation conduit 138 and is movable between open and closed positions.

When pump 100 is operating and valve 148 is open, liquid in sealed vapor tank 136 will pass through recirculation conduit 138 and connecting conduit 144 into inlet line 112 so that the liquid will pass through pump 100 and flow meter 130 and ultimately will be delivered to transport truck 24. A pressure valve 166 may also be connected to pump 100 and to vapor tank 136 with a conduit 167 so that when pump 100 ceases operation any expansion of gas or liquid therein will cause valve 166 to open and communicate vapor or liquid into sealed expansion tank 136 through conduit 167. Liquid in vapor tank 136 may be communicated into inlet line 112 through recirculation conduit 138. The liquid may be, for example, condensate from vapor removed by pressure valve 132.

A suction conduit 150 may comprise a suction hose 152 and a suction pipe 154. A valve 156 which may be a ball valve 156 is connected in suction conduit 150. Suction conduit 150 is connected to connecting conduit 144. When valve 156 is in the open position and system 10 is operating, suction conduit 150 will draw liquid from a drip or catch pan 158 that may be placed in the trailer 70 and communicated back into inlet line 112 through connecting conduit 144. Thus, system 10 has a reclamation system or reclamation process which maximizes the amount of liquid transferred by collecting liquid from vapor tank 136 and any liquid that may leak from the connection of lines or other components. The reclamation system may include, for example, vapor tank 136, and the conduits that communicate liquid from vapor tank 136 to inlet line 112, and suction conduit 150.

A temperature sensor 160 is connected in outlet line 120 to measure the temperature of the liquid exiting pump 100 through pump outlet 104 prior to the time the liquid enters flow meter 130. The sensed temperature will be sent to a computer and utilized to calculate a net amount of liquid transferred as will be explained in more detail hereinbelow. Connecting lines are not shown and it is understood that the temperature sensor 160 may be connected either by wires, or wirelessly, by any means known in the art to communicate and send a signal representing the sensed temperature to a computer. Liquid from pump 100 will pass through flow meter 130 and will exit outlet line 120 into outlet hose 46. An outlet valve 162 which is preferably a ball valve movable between open and closed positions is positioned in outlet line 120. Outlet line 120 may also have a safety valve 164 therein which as will be explained in more detail hereinbelow will shut off when transport truck 24 or a compartment therein, has reached its capacity.

A computer 170 or meter register 170 is mounted in the trailer, and may be, for example, a Top Tech single meter preset (SMP) computer. SMP computer 170 will receive temperature measurements from temperature sensor 160, flow measurements from flow meter 130 and will perform a gross to net calculation so that the amount of liquid being transferred can be immediately determined. Trailer 70 is preferably a multi-compartment trailer and thus includes a pump compartment 172, a generator compartment 174 and an office compartment 176. Hose storage tubes 178 may be mounted on a wall in pump compartment 172 and may extend into engine compartment 174. Hose storage tubes 178 are utilized to store inlet hose lengths 40 and 42, and outlet hose lengths 48 and 50. A wall 180 separates pump compartment 172 from engine compartment 174 and will preferably sealingly separate compartments 172 and 174. Thus, any openings through which hose storage tubes 178 extend and any joints will be adequately sealed to prevent any air or vapors from passing between the compartments 172 and 174.

An engine 182, a fuel tank 184 and a generator 186 are mounted in engine compartment 174. Engine 182 and generator 186 may be of a type known in the art and may be, for example, a Deutz diesel motor and generator pack. The fuel source for fuel tank 184 which will operate engine 182 may be the fuel being transferred or may be other types of fuel. Engine compartment 174 may have an exhaust in the top of trailer 70, and an air intake through a wall or floor of trailer 70. Engine 182 will power generator 186 which will in turn be connected in a manner known in the art, and will provide electric power to all of the components that require electric power in pump compartment 172 such as for example SMP computer 170, flow meter 130, pump motor 106, grounding components, heaters, air conditioners, lights, other computers and any other components that require electric power. All electrical wiring will be shielded. An air compressor 188 may also be housed in generator compartment 174 and may be utilized to blow the fuel from the inlet and outlet hoses 38 and 46, respectively, at the end of the transferring procedure as will be described in more detail.

Because the generator/engine compartment 174 is separated from pump compartment 172, system 10 may be utilized with low flash fuels such as gasoline, ethanol, and other low flash products. The system may be utilized to transfer any type of fuel or other liquid and the examples provided herein are non-limiting. Office compartment 176 is separated from engine compartment 174 by a wall 190. A compressed gas tank 192 which preferably will contain an inert gas may be stored in trailer 70, for example, in office compartment 176. The inert gas in compressed gas tank 192 may be utilized to expel fluid from inlet hose 38 and from outlet hose 46 as will be described herein in cases where the liquid being transferred is a low flash fuel or other gases where use of such gas is preferred. The air compressor in such cases is utilized only as a backup, for example, when gas may not be available. Office compartment 176 may have chairs and/or a laptop or other computer 193 along with a printer 191 therein.

Trailer 70 when in use is double grounded. Trailer 70 has a grounding clamp 194 connected to a grounding node 195 and tank car 16. A grounding node 196 is connected by a cable 198 and clamp 199 to the railroad track on which tank car 16 is resting. Grounding node 196 is in turn connected to monitoring system 197 which may be, for example, an Earth Rite sensor 197. If continuity is lost, sensor 197 will send a signal to shut off power to generator 186 and to close valve 164. A monitor 200 is mounted in trailer 70. A cord 201 which may be referred to as a Scully cord 201 with a connector 203 thereon is connected to send a signal to monitor 200. Connector 203 is adapted to connect to a receptacle on transport truck 24. As is known in the art, transport truck 24 will have a probe 205 with a sensor to sense a hydrocarbon. Probe 205 may transmit a signal to monitor 200 through a line 207. Monitor 200 will be connected to shut down power and send a signal to safety valve 164 to close to prevent overfill when probe 205 sends a signal to indicate maximum capacity. Likewise sensor 160, valve 132 and other components may be electrically connected and connected by wires or wirelessly to communicate with SMP computer 170 which may likewise be communicating with computer 193 in office compartment 176 either wirelessly or by wired connection as is known in the art.

In operation, trailer 70 will be pulled alongside railroad tank car 16 and transport truck 24. Scully cord 201 will be plugged into a Scully cord receptacle on transport truck 24 and grounding clamp 194 will be attached to tank car 16 to provide grounding continuity. Valves 114, 148, 156 and 162 may be closed as hookups are made. Inlet hose 38 is connected to valve 22 and inlet connector 116, while outlet hose 46 is connected to transport valve 36 and outlet connector 126.

Prior to hookup, the operator of system 10 may input certain data into SMP computer 170 through keypad entry. For example, the operator may enter a password which will be unique to the driver picking up the load. Account information, namely, the transporter and the buyer of the fuel may be entered as well. SMP computer 170 will therefore have identifying information which may be communicated to onboard computer 193 in office compartment 176. Such information may also be securely accessible by a computer wirelessly through the Internet by the fuel seller. The type of liquid being transported is also entered, and the amount of liquid to be transferred may be entered. While the discussion herein refers to filling a transport truck, it is understood that the transport truck may have separate compartments and the operation herein will apply with respect to each compartment being filled.

Once the account information is entered, hookups are made as described herein and valves 114, 162 and 148 may be opened. If desired, valve 156 may be opened as well so that any leakage that falls into a drip pan which may be placed below the pump and motor and the inlet and outlet lines may be collected through suction conduit 150 and delivered into inlet line 112. Suction will be created when pump 100 is operating. Engine 182 will be started and prior to entry of any information, generator 186 will provide power for SMP computer 170. Pump 100 may be actuated and the transferring process will begin after the entry of the desired information. If Scully cord 201 is not properly connected, or if grounding clamp 194 is not properly connected and grounded, a safety switch will prevent power from starting pump motor 100. In addition, safety valve 164 will close to prevent flow therethrough if grounding is lost.

As liquid is transferred to transport trailer 28 from tank 18, vapors in transport trailer 28 are transferred through vapor conduit 62 into tank 18 so that the closed loop transfer system prevents or at least lessens the amount of vapor vented to the atmosphere. The closed loop transfer system is one of the features that render the system 10 intrinsically safe.

As pump 100 operates, vapor is removed from the liquid being transferred with pressure valve 132, and any condensate or other liquid that collects in sealed vapor tank 136 is transferred back into inlet line 112 through recirculation conduit 138. Thus, system 10 has a vapor capture system which comprises pressure valve 132, vapor tank 136 and the connecting lines and conduits that provide for communication of vapor into tank 136, and liquid from tank 136 back into inlet line 112. Sealed tank 136 may have a relief valve so that if a vacuum in the tank exceeds the tank capacity, the vacuum relief valve will open.

As system 10 is operating, a signal representing the temperature of the liquid being transferred will be sent to SMP computer 170. When transport trailer 28 or the compartment thereof being filled has reached its capacity, a signal will be sent to monitor 200 which will cause safety valve 164 to close and generator 186 to stop providing power so that the system will shut down and prevent overfill.

Once the liquid has been transferred air compressor 188, compressed tanks 192, or other source of compressed gas or air may be used to flush inlet and outlet hoses 38 and 46, respectively. For example, an inlet gas hose 204 may be connected to gas line connector 206 and a valve 208 opened so that gas, such as air or other gas can pass into inlet hose 38. Compressed gas from tank 192, or air from compressor 188, or from a standard air system on truck 24 through fitting 210 may be used to flush inlet hose 38 and push liquid to pump 100. Compressed gas from tank 192 may be used when the liquid is a low flash fuel. When all liquid is pumped, pressure valve 132 will divert air out to vapor tank 136. Inlet valve 114 is closed, as is outlet valve 162. An outlet gas hose 212 will be connected at one end to a source of gas or air, as described with respect to inlet gas hose 204, and the second end will be connected to a valved fitting 214 in outlet line 120. Compressed gas tank 192 or other source of gas or air to be used can then be utilized to expel liquid in outlet hose 46 and push the liquid into transport trailer 28. Temperature and flow information transmitted to SMP computer 170 are utilized by SMP computer 170 to calculate the net amount of liquid transferred. The calculations are made using known algorithms and API (American Petroleum Institute) conversion tables which use the measured temperature to determine a net amount from the gross amount of liquid measured by meter 130. Previously, the gross to net calculation was made by sampling fuel from a tank car to measure the specific gravity and determine the temperature. The calculation is now made by the SMP computer that utilizes known algorithms and/or API tables to convert gross to net. This information along with information regarding the transporter and the buyer of the liquid is sent to computer 193 in office compartment 176. At that point, a bill of lading can automatically be generated and provided to the transporter. Thus, the entire transaction can occur on the spot.

The operation of system 10 as described herein is directed to unloading tank car 18 and filling or loading transport trailer 28. System 10 may be used to perform the reverse process, namely, unloading transport trailer 28 and filling tank car 16. To do so, the connections on inlet and outlet hoses 38 and 46 are reversed, so that pump outlet 104 is connected to hose 38, and pump inlet 102 is connected to hose 46. System 10 is to be double grounded. System 10 can be operated in the manner described herein to load tank car 16 and unload transport trailer 28. Vapor conduit 62 will communicate vapors from tank car 16 to transport trailer 28. The volume of liquid to be transferred can calculate the amount to be transferred into the tank car by utilizing API tables.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A portable system for transferring a liquid from a first tank to a second tank comprising:

a trailer towable by a vehicle;

a pump with a pump inlet and a pump outlet mounted to the trailer;

an inlet conduit connectable to the pump inlet and to the first tank;

an outlet conduit connectable to the second tank and to the pump outlet;

a flow meter mounted on the trailer in communication with the pump outlet;

a pressure valve for removing vapor from the liquid before it enters the flow meter such that only liquid passes to the flow meter;

a vapor tank mounted on the trailer; and a pressure valve line for communicating vapor removed by the pressure valve to the vapor tank.

2. The portable system of claim 1 further comprising a vapor conduit connected to the first and second tanks, wherein vapor from the second tank is communicated into the first tank, as liquid from the first tank is communicated into the second tank.

3. The portable system of claim 1, the trailer comprising:

a pump compartment in which the pump is mounted; and an engine compartment separated from the pump compartment, wherein the engine compartment comprises a fuel-powered engine and a generator driven by the engine for providing power to a pump motor in the pump compartment.

4. The portable system of claim 1, further comprising a temperature sensor mounted in the trailer and positioned to measure the temperature of liquid passing through the pump outlet prior to the time the liquid enters the flow meter.

5. The portable system of claim 4, further comprising a computer mounted to the trailer for receiving signals from the temperature sensor and flow meter and calculating a net amount of liquid transferred from the first tank to the second tank based on both the signal from the temperature sensor and the flow meter.

6. A portable system for transferring a liquid from a first tank, which is extrinsic to said portable system, to a second tank, which is extrinsic to said portable system, comprising:

a trailer connectable to a vehicle;

a pump having a pump inlet and a pump outlet mounted on the trailer;

an inlet hose connectable to the first tank and the pump inlet for communicating liquid from the first tank to the pump;

an outlet hose connectable to the second tank and the pump outlet for communicating the liquid from the pump to the second tank; and a vapor conduit having a first end connectable to the first tank and a second end connectable to the second tank, wherein vapor from the second tank may be communicated through the vapor conduit into the first tank as liquid from the first tank enters the second tank.

7. The system of claim 6 wherein the first tank is a railroad tank car and the second tank is a transport trailer.

8. The system of claim 6 wherein the first tank is a transport trailer and the second tank is a railroad tank car.

9. The portable system of claim 6, further comprising:

a fuel-powered engine mounted in the trailer;

a generator driven by the engine for providing power to an electric motor that drives the pump, wherein the trailer is separated into a plurality of compartments and wherein the fuel-powered engine and pump are in separate compartments.

10. The portable system of claim 6, further comprising a flow meter for measuring the amount of liquid pumped from the pump outlet to the outlet hose.

11. The portable system of claim 10, further comprising a temperature sensor mounted on the trailer for measuring the temperature of the liquid from the outlet of the pump prior to the time the liquid enters the flow meter.

12. The portable system of claim 11, further comprising a computer in the trailer for receiving signals from the temperature sensor and the flow meter, and for performing a gross to net calculation for converting the gross amount of liquid through the meter to a net amount of liquid based on both the signal from the temperature sensor and the flow meter.

13. The portable system of claim 10, further comprising a pressure valve for removing vapor from the liquid before it enters the flow meter such that only liquid passes to the flow meter.

14. The portable system of claim 13, further comprising:

a vapor tank mounted on the trailer for receiving vapor from the pressure valve; and a pressure valve line for communicating vapor removed by the pressure valve to the vapor tank.

15. The portable system of claim 14, further comprising a recirculation line connected to the vapor tank for recirculating liquid in the vapor tank to the pump inlet.

16. A portable system for transferring a liquid from a first tank, which is extrinsic to said portable system, to a second tank, which is extrinsic to said portable system, comprising:

a trailer connectable to a vehicle, wherein the trailer is separated into a plurality of compartments;

a pump having a pump inlet and a pump outlet mounted in a first compartment of the trailer;

an inlet hose connectable to the first tank and the pump inlet for communicating liquid from the first tank to the pump;

an outlet hose connectable to the second tank and the pump outlet for communicating the liquid from the pump to the second tank;

a pump motor mounted in the first compartment for driving the pump;

a flow meter mounted in the first compartment for measuring the amount of liquid pumped from the pump outlet to the outlet hose;

a temperature sensor mounted in the first compartment for measuring the temperature of the liquid from the outlet of the pump prior to the time the liquid enters the flow meter;

a computer in the trailer for receiving signals from the temperature sensor and the flow meter, and for performing a gross to net calculation for converting the gross amount of liquid through the meter to a net amount of liquid based on both the signal from the temperature sensor and the flow meter;

a pressure valve located in the first compartment for removing vapor from the liquid before it enters the flow meter such that only liquid passes to the flow meter;

a vapor tank mounted in the first compartment for receiving vapor form the pressure valve;

a pressure valve line for communicating vapor removed by the pressure valve to the vapor tank;

a recirculation line connected to the vapor tank for recirculating liquid in the vapor tank to the pump inlet;

a fuel-powered engine mounted in the trailer, the fuel-powered engine being located in a second compartment in the trailer, the second compartment being sealed from the first compartment;

a generator driven by the engine for providing power to the pump motor that drives the pump, the fuel-powered engine being located in the second compartment; and a vapor conduit having a first end connectable to the first tank and a second end connectable to the second tank, wherein vapor from the second tank may be communicated through the vapor conduit into the first tank as liquid from the first tank enters the second tank.

17. The system of claim 16 wherein the first tank is a railroad tank car and the second tank is a transport trailer.

18. The system of claim 16 wherein the first tank is a transport trailer and the second tank is a railroad tank car.

* * * * *

UNITED STATES PATENT AND TRADEMARK OFFICE

CERTIFICATE OF CORRECTION

PATENT NO. : 8,393,360 B2
APPLICATION NO. : 13/351888
DATED : March 12, 2013
INVENTOR(S) : Michael C. Brakefield et al.

It is certified that error appears in the above-identified patent and that said Letters Patent is hereby corrected as shown below:

In the Claims:

Column 10, line 63, delete "form" and insert --from-- therefor.

Signed and Sealed this
Twenty-first Day of May, 2013

Teresa Stanek Rea
*Acting Director of the United States Patent and Trademark Office*